US010050373B2

(12) United States Patent
Wang

(10) Patent No.: US 10,050,373 B2
(45) Date of Patent: Aug. 14, 2018

(54) ELECTRICAL CONNECTOR AND METHOD OF MAKING THE SAME

(71) Applicant: FOXCONN INTERCONNECT TECHNOLOGY LIMITED, Grand Cayman (KY)

(72) Inventor: Cai-Yuan Wang, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/599,909

(22) Filed: May 19, 2017

(65) Prior Publication Data

US 2017/0338586 A1 Nov. 23, 2017

(51) Int. Cl.

| | |
|---|---|
| ***H01R 13/52*** | (2006.01) |
| ***H01R 4/28*** | (2006.01) |
| ***H01R 13/426*** | (2006.01) |
| ***H01R 13/6585*** | (2011.01) |
| ***H01R 24/60*** | (2011.01) |
| ***H01R 43/00*** | (2006.01) |
| *H01R 107/00* | (2006.01) |

(52) U.S. Cl.

CPC ..... *H01R 13/5202* (2013.01); *H01R 4/28* (2013.01); *H01R 13/426* (2013.01); *H01R 13/5219* (2013.01); *H01R 13/6585* (2013.01); *H01R 24/60* (2013.01); *H01R 43/005* (2013.01); *H01R 2107/00* (2013.01)

(58) Field of Classification Search

CPC . H01R 24/60; H01R 13/6598; H01R 13/5202
See application file for complete search history.

(56) References Cited

U.S. PATENT DOCUMENTS

| | | | | |
|---|---|---|---|---|
| 8,461,465 | B2 | 6/2013 | Golko | |
| 8,573,995 | B2 | 11/2013 | Golko | |
| 9,502,837 | B2 | 11/2016 | Kao | |
| 9,537,263 | B2 * | 1/2017 | Gao | H01R 13/6582 |
| 2015/0270661 | A1 | 9/2015 | Kao | |
| 2015/0295362 | A1 | 10/2015 | Tziviskos | |

FOREIGN PATENT DOCUMENTS

| | | |
|---|---|---|
| CN | 204243358 | 4/2015 |

OTHER PUBLICATIONS https://en.wikipedia.org/wiki/Metal_injection_molding, "Metal Injection Molding," Wikipedia, retrieved Oct. 18, 2017.*

* cited by examiner

*Primary Examiner* — Ross Gushi
(74) *Attorney, Agent, or Firm* — Wei Te Chung; Ming Chieh Chang

(57) ABSTRACT

An electrical connector includes an insulative housing, a number of conductive terminals affixed to the insulative housing, a metal shielding plate affixed to the insulative housing and including a fixing plate, and a shielding shell formed by Metal Injection Molding and enclosing the insulative housing for forming a receiving room. The fixing plate is spot-welded onto the shielding shell for forming a welding spot. The thickness of the shielding shell spot-welded onto the welding spot is twice as thick as the fixing plate at least. The shielding shell has more than twice the rigidity of the fixing plate.

15 Claims, 8 Drawing Sheets

ELECTRICAL CONNECTOR AND METHOD OF MAKING THE SAME

BACKGROUND OF THE DISCLOSURE

1. Field of the Disclosure

The present invention relates to an electrical connector including a shielding shell formed by metal injection molding and a metal shielding plate spot-welded to the shielding shell to provide a durable construction.

2. Description of Related Arts

U.S. Pat. No. 8,461,465, issued on Jun. 11, 2013, discloses a dual orientation connector manufactured by constructing a flex circuit, attaching contact pucks to the flex circuit, and attaching the flex circuit to a ground ring. U.S. Pat. No. 8,573,995, issued on Nov. 5, 2013, discloses that such ground ring may be fabricated using, for example, a metal injection molding process.

An improved electrical connector is desired.

SUMMARY OF THE DISCLOSURE

Accordingly, an object of the present disclosure is to provide an electrical connector ensuring the insulative housing affixed to the shielding shell.

To achieve the above object, an electrical connector includes an insulative housing, a number of conductive terminals affixed to the insulative housing, a metal shielding plate affixed to the insulative housing and including a fixing plate, and a shielding shell formed by metal injection molding and enclosing the insulative housing for forming a receiving room. The fixing plate is spot-welded onto the shielding shell for forming a welding spot. The thickness of the shielding shell spot-welded onto the welding spot is twice as thick as the fixing plate at least. The shielding shell has more than twice the rigidity of the fixing plate.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
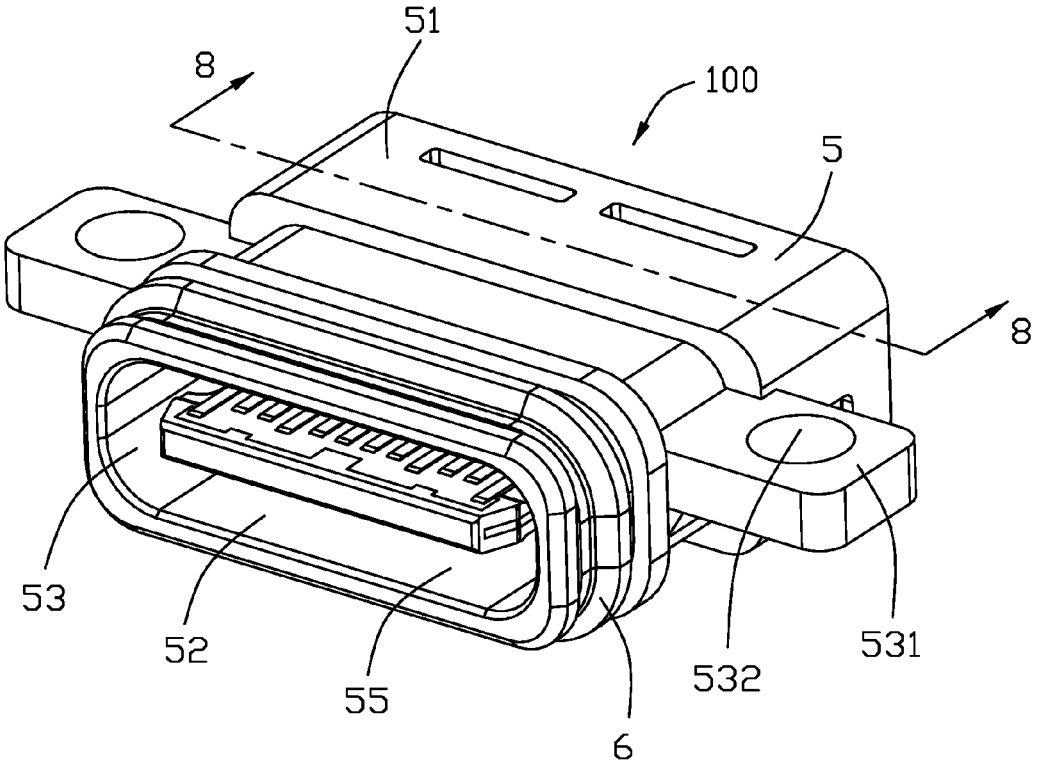
FIG. 1 is a perspective, assembled view of an electrical connector.

Reference will now be made in detail to the embodiments of the present disclosure. The first embodiment is shown from FIGS. 1 to 8. The electrical connector has an insertion opening engaging with a mating connector. The electrical connector has a front-to-rear direction, a transverse direction perpendicular to the front-to-rear direction, and a vertical direction perpendicular to both the front-to-rear direction and the transverse direction. The front-to-rear direction and the transverse direction define a horizontal plane.

Referring to FIGS. 1 to 7, an electrical connector 100 comprises an insulative housing 1, a number of conductive terminals 2 affixed to the insulative housing, a metal shielding plate 3 affixed to the insulative housing 1, a rubber sheet 4 formed in a rear end of the insulative housing 1, a shielding shell 5 enclosing the insulative housing 1, and an o-ring 6 attached to an outer surface of a front end of the shielding shell 5.

Figure 5:
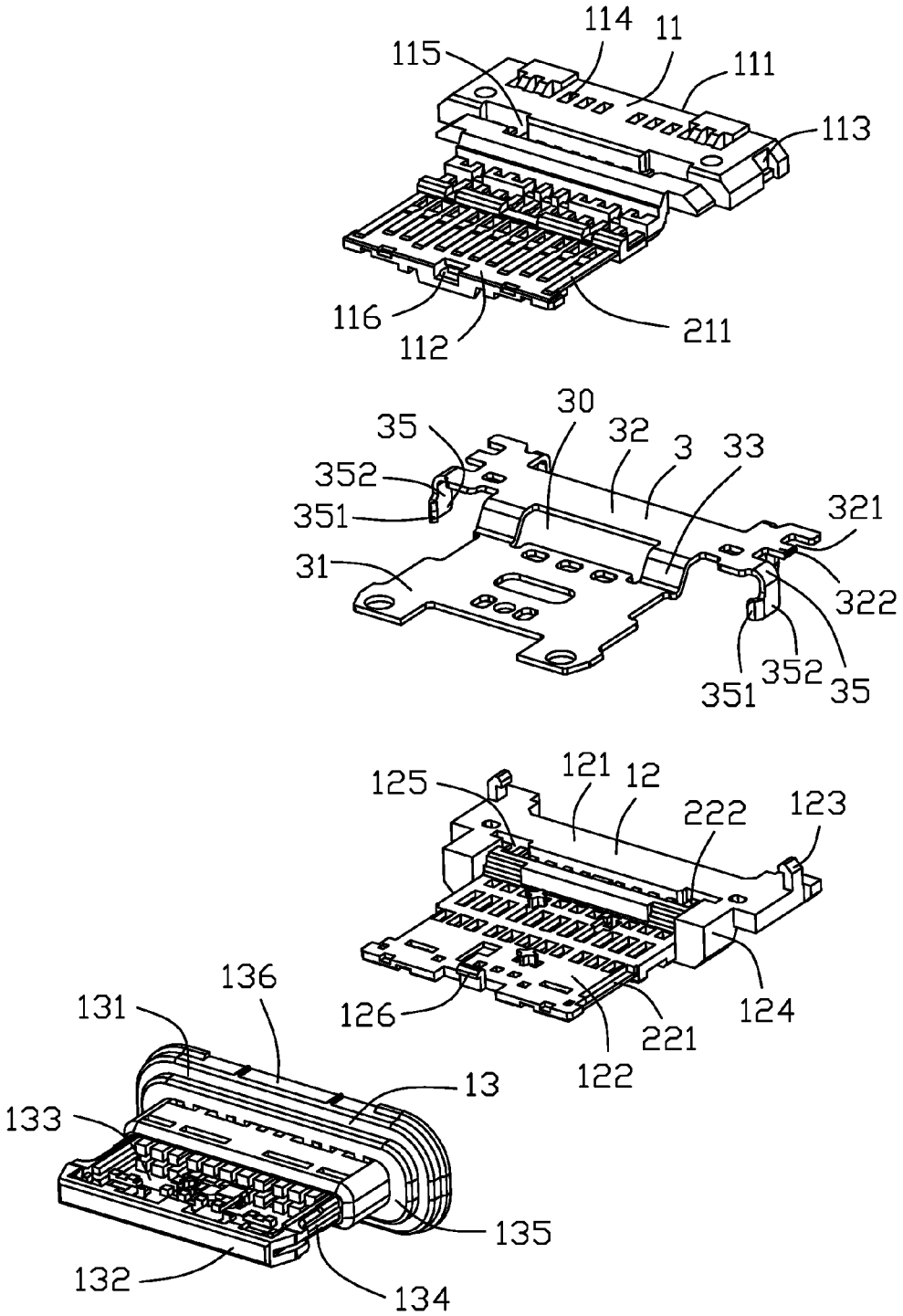
FIG. 5 is an exploded view of an insulative housing, a number of terminals and a metal shielding shell of the electrical connector.
Figure 6:
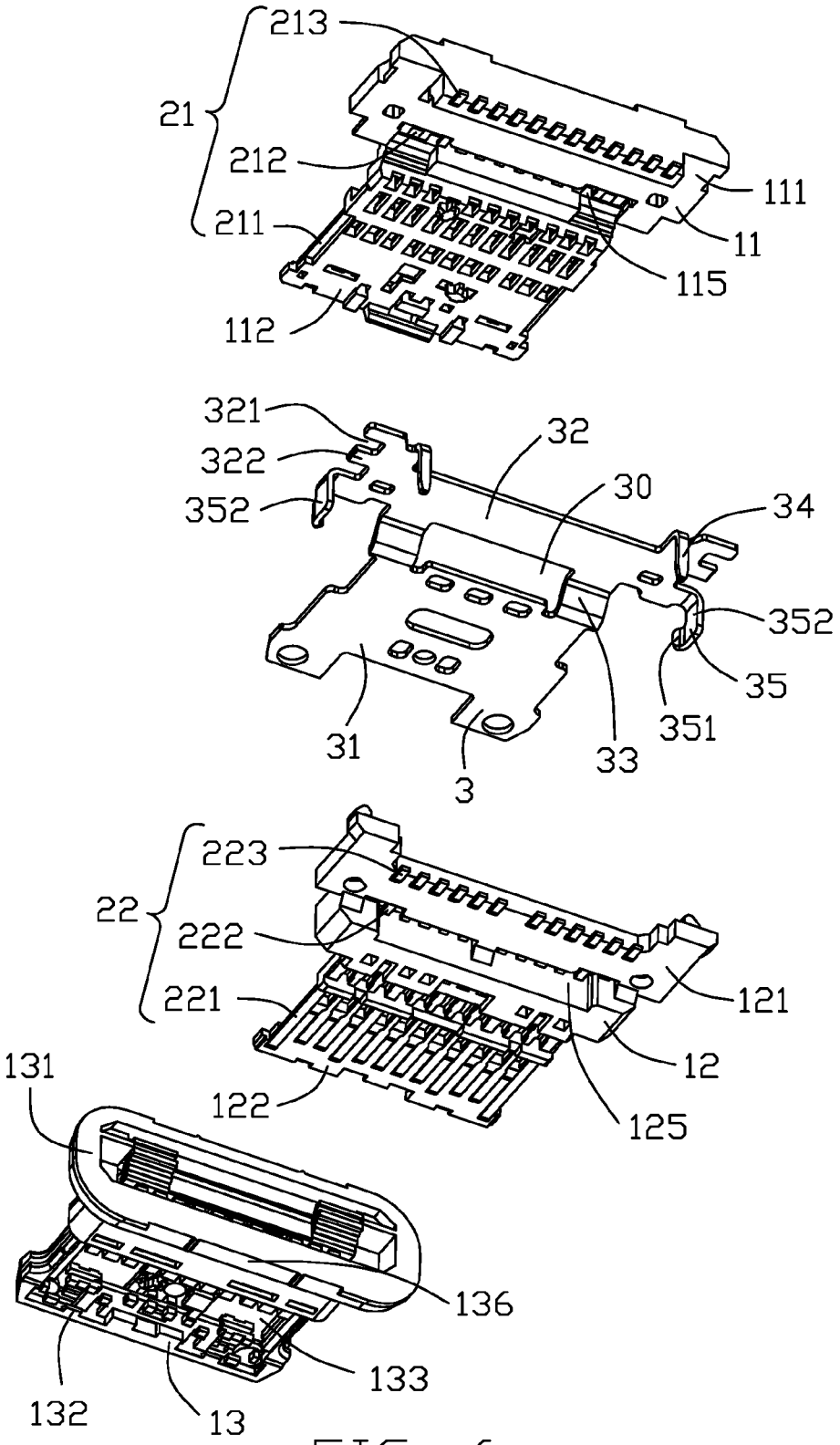
FIG. 6 is another exploded view of the electrical connector taken from FIG. 5.

Referring to FIGS. 5 to 6, the insulative housing 1 includes a first insulator 11, a second insulator 12 insert-molded with the first insulator 11, and a third insulator 13 insert-molded with the first insulator 11 and the second insulator 12. The first insulator 11 includes a first base portion 111 and a first tongue portion 112 extending forwardly from the first insulator 111. The first base portion 111 includes a pair of notches 113 arranged laterally, a number of apertures 114 penetrating a top surface and a bottom surface of the first base portion 111, a pair of first penetrating holes 115 arranged in the transverse direction and located in front of the apertures 114. The first tongue portion 112 includes a buckling hole 116 at a front end thereof. The second insulator 12 includes a second base portion 121 and a second tongue portion 122 extending forwardly from the second base portion 121. The second base portion 121 includes a pair of protrusions 123 extending upwardly, a pair of tubers 124 located in front of the protrusions 123 and a pair of second penetrating holes 125 close to the second tongue portion 122 in the transverse direction. The second tongue portion 122 includes a buckling portion 126 engaged with the buckling hole 116. The third insulator 13 includes a third base portion 131 and a third tongue portion 132 extending forwardly from the third base portion 131. The third tongue portion 132 includes a hollow section 133 and a pair of fixing grooves arranged laterally. The third base portion 131 includes a first stepped portion 135 close to the third tongue portion 132 and a second stepped portion 136 located behind the first stepped portion 135. The size of the first stepped portion 135 in the transverse direction and vertical direction is smaller than that of the second stepped portion 136. The first base portion 111, the second base portion 121 and the third base portion 131 form a base portion. The first tongue portion 112, the second tongue portion 122, and the third tongue portion 132 form a tongue portion.

The conductive terminals 2 include a number of first terminals 21 and second terminals 22. Each first terminal 21 includes a first contacting portion 211, a first soldering portion 213, and a first connecting portion 212 connecting the first contacting portion 211 with the first soldering portion 213. Each second terminal 22 includes a second contacting portion 221, a second soldering portion 223 and a second connecting portion 222 connecting the second contacting portion 221 and the second soldering portion 223. The first contacting portions 211 are opposite to the second contacting portions 221 along a vertical direction. The first soldering portions 213 are allocated in a first horizontal plane. The second soldering portions 223 are allocated in a second horizontal plane different from the first horizontal plane. Each first contacting portion 211 of the first contacts 21 is positioned in reverse symmetry with respect to a respective one of the second contacts.

The metal shielding plate 3 includes a first supporting portion 31, a second supporting portion 32, an inclining portion 33 connecting the first supporting portion 31 with the second supporting portion 32, and a pair of soldering pins 34 bending downwardly from a rear end of the second supporting portion 32. The inclining portion 33 includes a through hole 30. The metal shielding plate 3 further includes a pair of fixing plates 35 bending downwardly from two sides of the second supporting portion 32, a pair of protruding portions 322 located behind the fixing plates 35, and a pair of recesses 321 located behind the protruding portions 322. Each fixing plate is shaped as "L" and includes a spot-welding portion 352 extending downwardly and a resisting portion 351 extending forwardly from a front end of the spot-welding portion 352.

Referring to FIGS. 1 to 4, the shielding shell 5 is formed by Metal Injection Molding. The insertion opening of the shielding shell 5 is shaped as Rounded Rectangle. The shielding shell 5 has a receiving room 55. The shielding shell 5 includes a top wall 51, a bottom wall 52 disposed opposite to the top wall 51 and a pair of lateral walls 53 connecting the top wall 51 and the bottom wall 52. The shielding shell 5 includes a collar 50 depressed in an outer surface of a front end of the shielding shell 5. The size of the top wall 51 is longer than that of the bottom wall 52 in the front-to-rear direction. The shielding shell 5 further includes a pair of first fixing portions 511 bending downwardly from the lateral sides of a rear end of the top wall 51, a pair of second fixing portions 531 extending outwardly from the lateral walls 53, a pair of positioning holes 532 located at the second fixing portions 531, and an annular portion 54 received in the receiving room 55 and connecting with the top wall 51, the bottom wall 52, and the lateral walls 53. The annular portion 54 includes a front annular block 541 protruding into the receiving room 55 and a receiving groove 542 located behind the front annular block 541 and depressed inward.

The o-ring 6 is shaped like circle ring. The o-ring 6 includes a smooth inner surface, an uneven outer surface and an annular convex 61 formed at the outer surface for making a better effect of waterproof between the mating connector.

The method of making the electrical connector 100 includes the following steps: in the first step, providing the insulative housing 1 affixed with the conductive terminals 2. The first contacts 21 are insert-molded with the first insulator 11 to form a first contact module. The second contacts 22 are insert-molded with the second insulator 12 to form a second module. The first contacting portions 211 are exposed to the first tongue portion 112. The first connecting portions 212 are partially exposed to the first penetrating holes 115. The first soldering portions 213 extend outwardly from the first base portion 111. The second contacting portions 221 are exposed to the second tongue portion 122. The second connecting portions 222 are partially exposed to the second penetrating holes 125. The second soldering portions 223 extend outwardly from the second base portion 121. Sandwich the metal shielding plate 3 between the first insulator 11 and the second insulator 12 in the vertical direction. The fixing plates 35 protrude outwardly from two lateral sides of the insulative housing 1 and laterally surround two lateral sides of the insulative housing 1. The pair of protrusions 123 is mated with the pair of notches 113. The buckling portion 126 is engaged with the buckling hole 116. The first supporting portion 31 is sandwiched between the first tongue portion 112 and the second tongue portion 122 while the second supporting portion 32 is sandwiched between the first base portion 111 and the second base portion 121. The through hole 30 makes the first insulator 11 contact with the second insulator 12. Each recess 321 is permissible for the protrusion 123 and the notch 113 assembly. The protruding portions 322 extend outwardly from the lateral sides of the first insulator 11 and the second insulator 12. Insert molding the first contact module and the second contact module with insulative materials to form the insulative housing 1. The third insulator 13 is formed during the process. The hollow section 133 receives the first tongue portion 112 and the second tongue portion 122. The first supporting portion 31 is received in the fixing groove 134.

In the second step: inserting the insulative housing 1 into the receiving room 55 of the shielding shell 5 along the rear-to-front direction. The base portion resists an inner surface/rearward surface of the annular portion 54. A front surface of the second stepped portion 136 resists against a rear surface of the front annular block 541. The resisting portion 351 optionally resists forwardly against a rear surface of the annular portion 54. The fixing plate 35 is spot-welded onto the shielding shell 5 for forming a welding spot. The spot-welding portions 352 are spot-welded onto an inner surface of the shielding shell 5 making the insulative housing affixed to the shielding shell 5. The thickness of the shielding shell 5 spot-welded onto the welding spot is twice as thick as the fixing plate 35 at least. The shielding shell 5 has more than twice the rigidity of the fixing plate 35.

Figure 2:
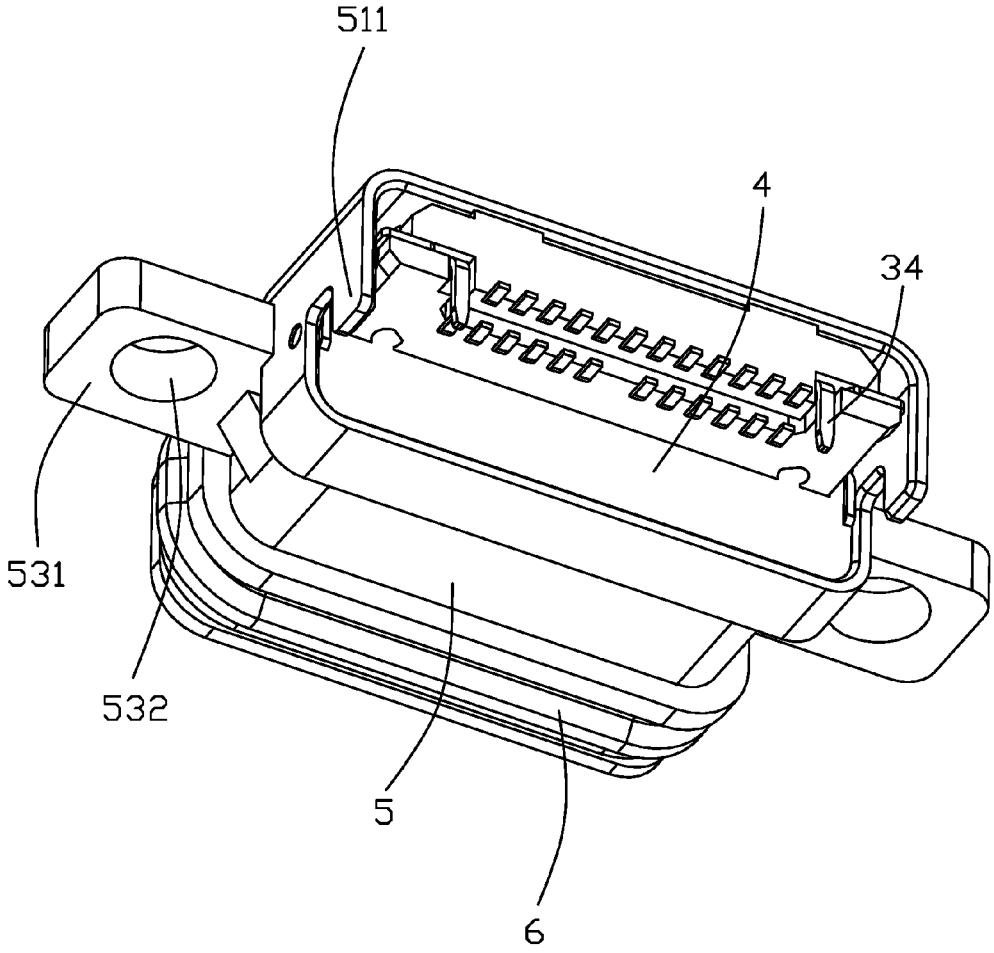
FIG. 2 is another perspective, assembled view of the electrical connector taken from FIG. 1.
Figure 3:
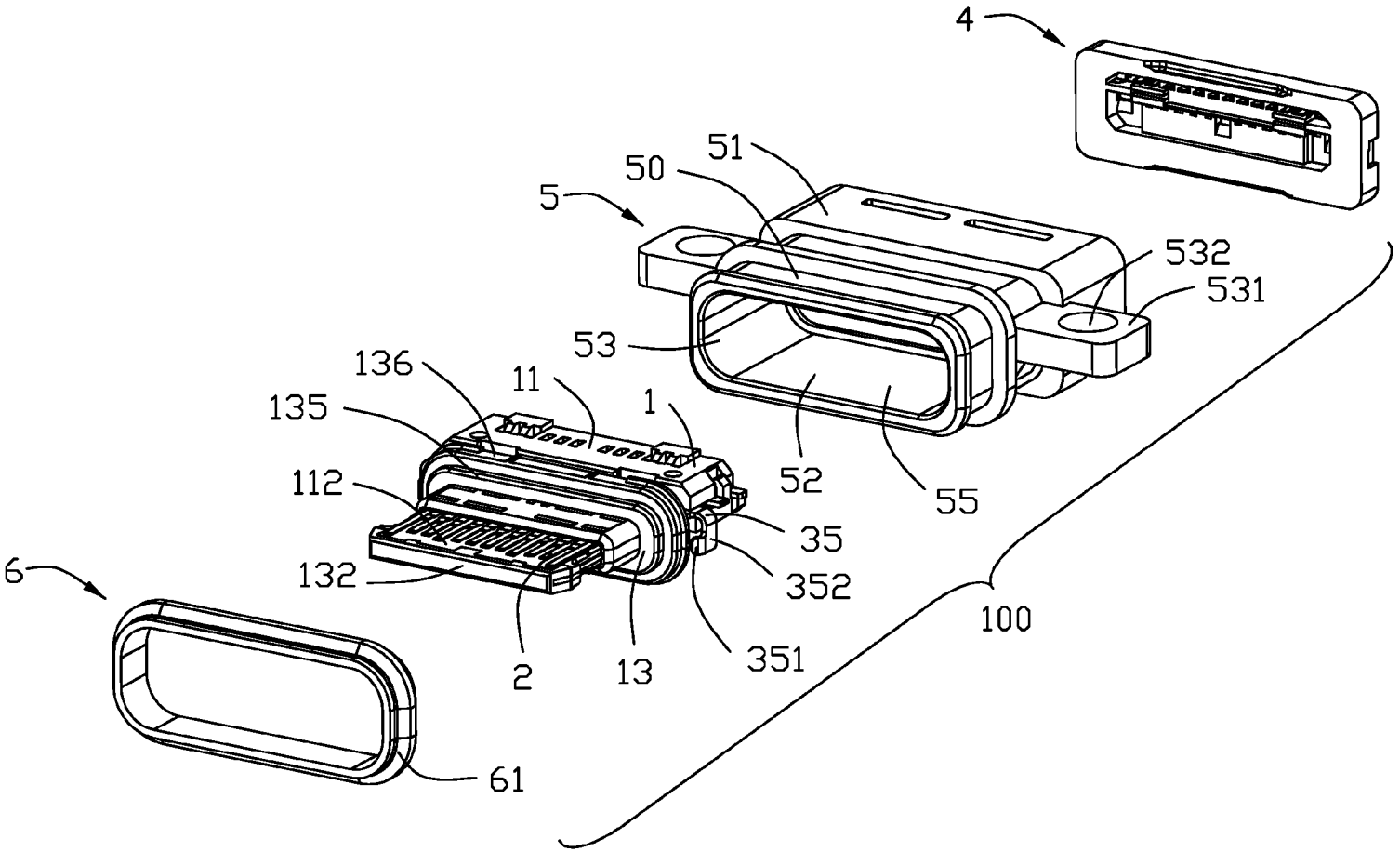
FIG. 3 is a partial exploded view of the electrical connector.
Figure 4:
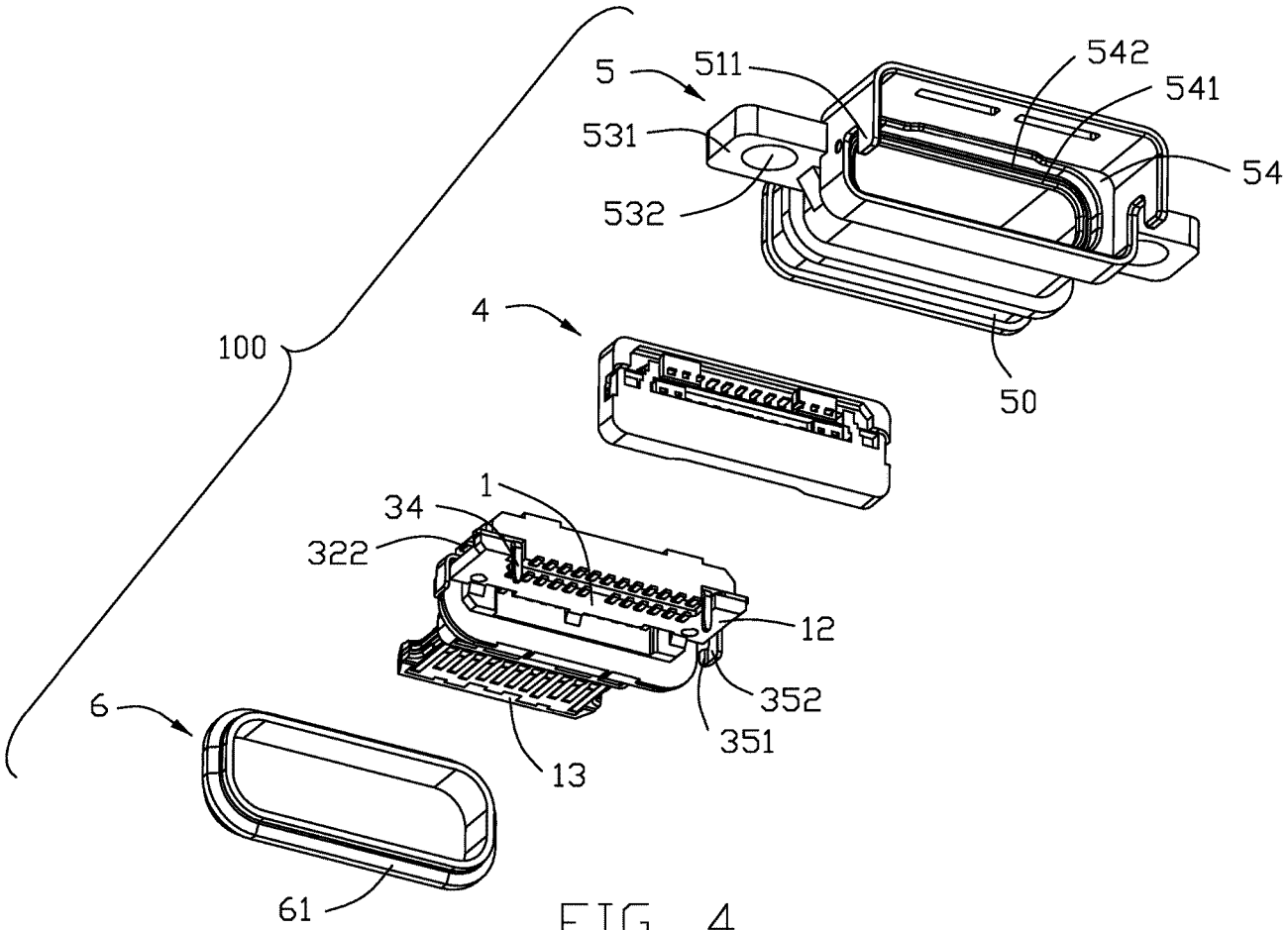
FIG. 4 is another partial exploded view of the electrical connector taken from FIG. 3.
Figure 7:
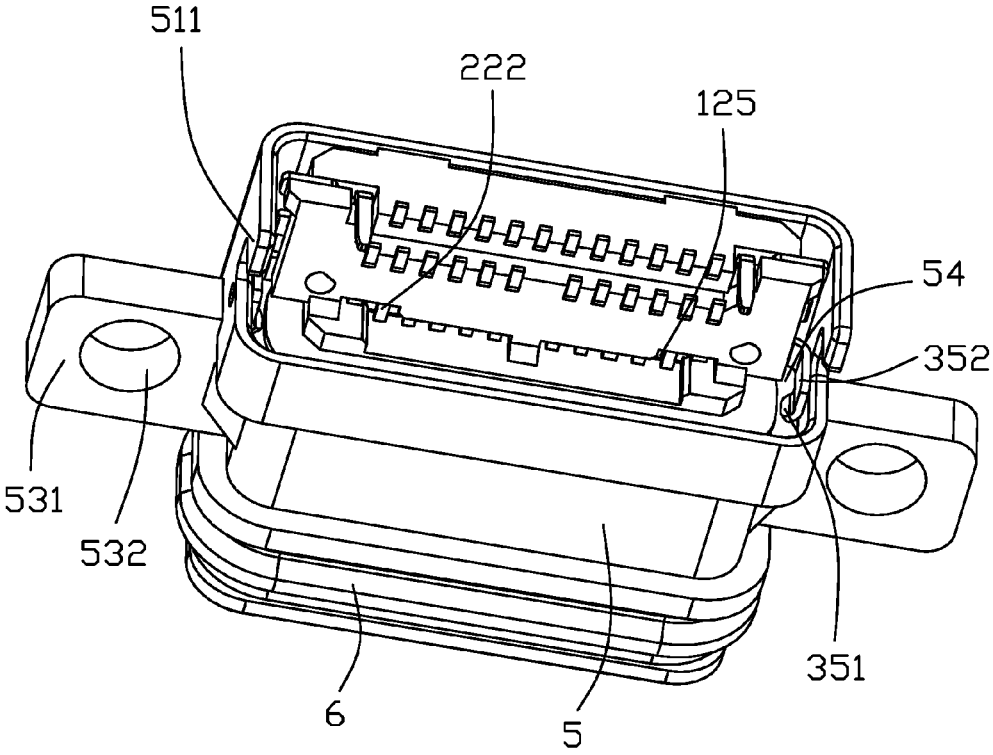
FIG. 7 is a perspective, assembled view of an electrical connector removing a rubber sheet.
Figure 8:
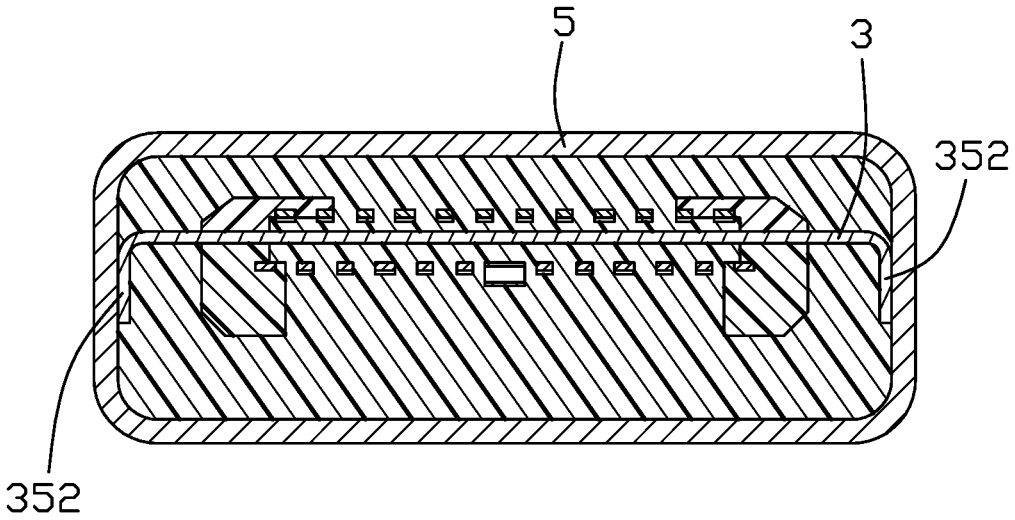
FIG. 8 is a cross-sectional view of the electrical connector taken along line 8-8 in FIG. 1.

Referring to FIG. 2 and FIG. 7, in the third step, the glue pours from the rear end of the insulative housing 1 to the receiving room 55 to form a rubber sheet 4 in the receiving room 55. The rubber sheet 4 fills in the first penetrating holes 115 and the second penetrating holes 125 to cover the conductive terminals 2 and expose the first connecting portions 212 and the second connecting portions 222. The o-ring 6 is attached to the collar 50.

Compared with prior arts, the shielding shell 5 is formed by Metal Injection Molding making the insulative housing affixed to the shielding shell by spot-welding the metal shielding plate to the shielding shell. The shielding shell is equipped with strong strength and rigidity making the spot-welding effect maintain a long time after the repeated use.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing;

a plurality of conductive terminals affixed to the insulative housing;

a metal shielding plate affixed to the insulative housing and comprising a fixing plate; and a shielding shell formed by metal injection molding and enclosing the insulative housing for forming a receiving room; wherein the fixing plate is spot-welded onto the shielding shell for forming a welding spot, and the thickness of the shielding shell spot-welded onto the welding spot is at least twice of that of the fixing plate.

2. The electrical connector as claimed in claim 1, wherein the fixing plate protrudes outwardly from and laterally surrounds two lateral sides of the insulative housing.

3. The electrical connector as claimed in claim 1, wherein the shielding shell comprises an annular portion having a front annular block protruding into the receiving room, the insulative housing comprises a base portion having a stepped portion, the base portion resists an inner surface of the annular portion, and the stepped portion resists a rear surface of the front annular block.

4. The electrical connector as claimed in claim 3, wherein the fixing plate is L-shaped and comprises a spot-welding portion extending downwardly and a resisting portion extending forwardly from the spot-welding portion, the resisting portion resists forwardly against a rear surface of the annular portion, and the spot-welding portion is spot-welded onto the shielding shell.

5. The electrical connector as claimed in claim 1, further comprising a rubber sheet formed by glue filling in a rear end of the insulative housing in the receiving room.

6. The electrical connector as claimed in claim 5, wherein the insulative housing comprises a first insulator and a second insulator assembled opposite to the first insulator, the first insulator comprises a first base portion having a pair of first penetrating holes, the second insulator comprises a second base portion having a pair of second penetrating holes, and the rubber sheet fills in the first penetrating holes and the second penetrating holes.

7. The electrical connector as claimed in claim 6, wherein the first base portion comprises a pair of notches disposed laterally, the second base portion comprises a pair of protrusions extending upwardly and engaging with the notches, the metal shielding plate comprises a pair of protruding portions located in a rear end of the fixing plate and a pair of recesses in a rear end of the protruding portions, and each recess is adapted for assembling the notch and the protrusion.

8. The electrical connector as claimed in claim 1, further comprising an o-ring, and wherein the shielding shell comprises a collar depressed in an outer surface of a front end of the shielding shell, and the o-ring is attached to the collar.

9. A method of making an electrical connector, comprising the steps of:

providing an insulative housing affixed with a plurality of conductive terminals, a metal shielding plate having a fixing plate, and a shielding shell formed by metal injection molding; and inserting the insulative housing into a receiving room of the shielding shell along a rear-to-front direction and spot-welding the fixing plate onto the shielding shell; wherein the shielding shell comprises an annular portion having a front annular block protruding into the receiving room, the insulative housing comprises a base portion resisting an inner surface of the annular portion and having a stepped portion resisting a rear surface of the front annular block, and the fixing plate comprises a spot-welding portion spot-welded onto the shielding shell; wherein said shielding plate is embedded within the housing.

10. The method as claimed in claim 9, wherein the fixing plate further comprises a resisting portion extending forwardly from the spot-welding portion and resisting forwardly against a rear surface of the annular portion.

11. The method as claimed in claim 9, wherein a thickness of a corresponding portion of the shielding shell welded with the spot-welding portion is at least twice of that of the spot-welding portion.

12. An electrical connector comprising:

an insulative housing including a base portion from which a tongue portion extends;

a plurality of conductive terminals affixed to the insulative housing;

a metal shielding plate made by stamping from sheet metal and affixed to the insulative housing and comprising a fixing plate; and a shielding shell formed by metal injection molding and enclosing the insulative housing for forming a receiving room, said shielding shell further forming an annular portion with a rearward abutting surface thereon; wherein during assembling, via forwardly inserting the insulative housing into the receiving room, the base portion abuts against a rearward surface of the annular portion and the fixing plate is spot-welded onto a corresponding portion of the shielding shell for preventing backward movement of the insulative housing relative to the shielding shell; wherein the fixing plate is relatively more flexible than the shielding shell not only because a thickness of the fixing plate is smaller than that of said corresponding portion of the shielding shell but also because said fixing plate is cantilevered while the shielding shell is rigid by a self-confined tubular structure thereof.

13. The electrical connector as claimed in claim 12, wherein said shielding plate is embedded within the tongue portion of the housing while the fixing plate is exposed by a lateral side of the housing.

14. The electrical connector as claimed in claim 13, wherein said fixing plate includes a front curved portion so as to ease insertion of the housing with fixing plate into the receiving room of the shielding shell without interference.

15. The electrical connector as claimed in claim 12, wherein a thickness of the corresponding portion of the shielding shell is twice of that of the fixing plate.

* * * * *